United States Patent [19]

Kimura

[11] Patent Number: 4,638,184

[45] Date of Patent: Jan. 20, 1987

[54] CMOS BIAS VOLTAGE GENERATING CIRCUIT

[75] Inventor: Kikuo Kimura, Tokyo, Japan

[73] Assignee: Oki Electric Industry Co., Ltd., Tokyo, Japan

[21] Appl. No.: 650,408

[22] Filed: Sep. 13, 1984

[30] Foreign Application Priority Data

Sep. 22, 1983 [JP] Japan ..... 58-174109

[51] Int. Cl.[4] ..... G05F 1/56

[52] U.S. Cl. ..... 307/297; 307/296 R; 323/286; 323/311

[58] Field of Search ..... 323/282, 286, 311; 363/19–21; 307/265, 296 R, 297

[56] References Cited

U.S. PATENT DOCUMENTS

| | | | |
|---|---|---|---|
| 4,233,672 | 11/1980 | Suzuki et al. | 307/296 R X |
| 4,300,061 | 11/1981 | Mihalich et al. | 307/297 |
| 4,344,121 | 8/1982 | Weber | 363/21 X |
| 4,355,277 | 10/1982 | Davis et al. | 363/21 X |
| 4,420,700 | 12/1983 | Fay et al. | 323/282 X |
| 4,430,582 | 2/1984 | Bose et al. | 307/297 |

*Primary Examiner*—Stanley D. Miller
*Assistant Examiner*—D. R. Hudspeth
*Attorney, Agent, or Firm*—Frishauf, Holtz, Goodman & Woodward

[57] ABSTRACT

A bias generating circuit for reducing an external DC power supply voltage to a predetermined, lower, stable DC voltage used as a power source for internal logic circuits in a semiconductor IC chip includes an oscillator for converting the external DC voltage into a pulse signal, a smoothing circuit for converting a pulse signal into the lower DC voltage, and a control circuit interposed between the oscillator and the smoothing circuit for varying the pulse duration of the pulse signal from the oscillator to a changed pulse signal, and for regulating the lower DC voltage to a predetermined amplitude in response to the voltage variation in the lower DC voltage. The control circuit comprises a CMOS inverter, a CMOS buffer circuit for varying the pulse duration of the output signal of the CMOS inverter, and a voltage compensating circuit for controlling the transconductance of the CMOS inverter in response to the variation of the lower DC voltage.

6 Claims, 4 Drawing Figures

CMOS BIAS VOLTAGE GENERATING CIRCUIT

BACKGROUND OF THE INVENTION

This invention relates to a bias generating circuit, or a DC voltage reducing circuit, suitable for an internal low voltage power source in a large-scale integrated circuit (IC) device.

In general, since digital electronic apparatuses composed of many MOS IC devices operate with TTL logic signals, the MOS IC devices are powered by using 5-volt power supply. On the other hand, MOS transistors in the MOS IC devices are remarkably being miniaturized with years. However, in the case such miniaturized MOS transistors are operated with the 5-volt power supply, they seriously suffer from hot electron and impact ionization phenomena, and the short-channel effect.

An advantageous method of precluding these adverse effects is to lower the power supply voltage. However, because system designers do not want any complexity in system design considerations and an increased number of power supplies, the 5-volt power supply has been used as a standard power source without change.

Therefore, in MOS IC devices, it is desired that the input and output circuits therein are powered on 5 volts to interface external logic circuits, while internal logic circuits are powered on a lower DC voltage (for example, 2.5 to 3 volts) of a magnitude that will not bring about the aforementioned physical phenomena.

SUMMARY OF THE INVENTION

It is therefore an object of the invention to provide a bias generating circuit capable of generating as an internal power source a lower, stable DC voltage for internal logic circuits in an IC chip by reducing an external DC power voltage.

Another object of the present invention is to provide a bias generating circuit which comprises a plurality of CMOS inverters.

According to the present invention, the foregoing objects are attained by providing a bias generating circuit capable of reducing an external DC power supply voltage to a lower DC bias voltage, comprising oscillating means for converting the external voltage into a first pulse signal, smoothing means for converting a second pulse signal into the lower DC bias voltage, and control means for varying a pulse duration of the first pulse signal from the oscillating means to generate the second pulse signal, and for regulating the lower DC bias voltage to a predetermined amplitude in response to a voltage variation in the lower DC bias voltage.

In one aspect of the invention, the control means includes a CMOS inverter for inverting the first pulse signal from the oscillating means, a CMOS buffer means for varying the pulse duration of the output signal of the CMOS inverter to output the second pulse signal to the smoothing means, and a voltage compensating means for controlling the transconductance of the CMOS inverter in response to the variation of the lower DC voltage.

In another aspect of the invention, the bias generating circuit includes a CMOS buffer means for varying the first pulse duration of the pulse signal from the oscillating means to output the second pulse signal, a CMOS inverter for inverting the second pulse signal from the CMOS buffer means, and a voltage compensating means for controlling the transconductance of the CMOS inverter in response to the variation of the lower DC voltage.

Thus, according to the invention, an external DC power supply voltage can be reduced to a predetermined and highly stable DC bias voltage used for powering internal logic circuits in a semiconductor chip. The invention is applicable to all forms of semiconductor IC devices such as large-scale memory ICs and microprocessor ICs.

The above and other objects, features and advantages of the invention will be more apparent from the following detailed description taken in connection with the accompanying drawings.

DETAILED DESCRIPTION

The present invention will now be described in detail with reference to the drawings.

In the description to follow, the transistors employed in the illustrated embodiments of the invention are enhancement-type MOS FETs.

Figure 1:
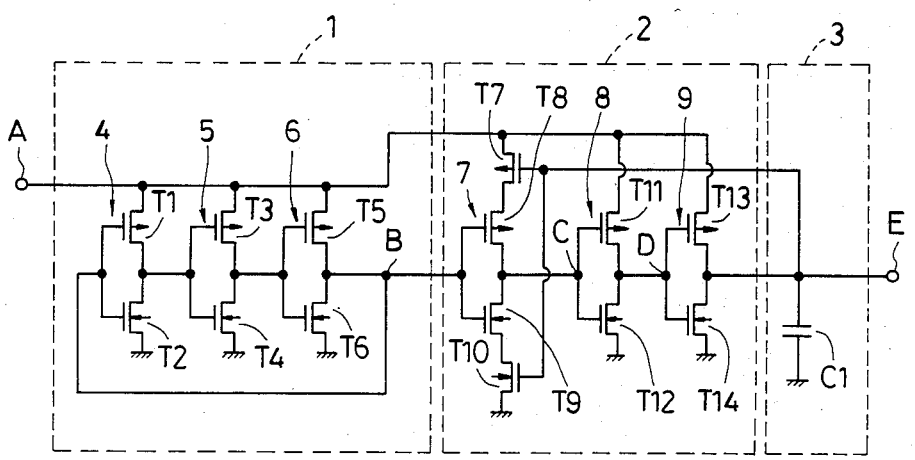
FIG. 1 is a circuit diagram illustrating a first embodiment of a bias generating circuit according to the present invention.

Referring first to FIG. 1 illustrating a first embodiment of the invention, the bias generating circuit is shown to comprise a ring oscillator 1 for converting an external voltage (for example, 5 volts) into a pulse signal, a control circuit 2 for varying the pulse width or duration of the output signal from the ring oscillator 1 and for regulating a lower DC output voltage to a predetermined amplitude in response to the DC output voltage, and a smoothing circuit 3 for converting the pulse signal from the control circuit 2 into the lower DC output voltage.

The ring oscillator 1 comprises three CMOS inverters serially connected which include P-type MOS transistors T1, T3, T5, and N-type MOS transistors T2, T4, T6. The input of the CMOS inverter 4 and the outpt of the CMOS inverter 6 are connected to a point B.

The control circuit 2 comprises a CMOS inverter 7, 8, 9, a P-type MOS transistor T7 and an N-type MOS transistor T10. The CMOS inverters include P-type MOS transistors T8, T11, T13, and N-type MOS transistors T9, T12, T14. The CMOS inverters 8 and 9 are serially connected to vary the pulse duration of the output signal from the CMOS inverter 7. The CMOS inverters 8 and 9 also act as a buffer for shaping the output signal of the CMOS inverter 7.

The P-type MOS transistor T7 has its source electrode connected to the external power voltage input terminal A and its drain electrode connected to the source electrode of the P-type MOS transistor T8, and the N-type MOS transistors T10 has its source electrode connected to the ground and its drain electrode connected to the source electrode of the N-type MOS transistors T9. The gates of the MOS transistors T7 and T10 are commonly connected to an output terminal E. The P-type MOS transistors T7 varies its conductive condition by an output voltage of the terminal E to control the transconductance (gm) of the P-type MOS transistor T8, while the N-type MOS transistor T10 varies its conductive condition by an output voltage of the terminal E to control the transconductance of the N-type MOS transistor T9.

In other words, the MOS transistors T7 and T10 act as a voltage compensating means for controlling the transconductance of the CMOS inverter 7 in response to the load variation of the output terminal E.

The smoothing circuit 3 comprises a capacitor C1 connected between ground and the output terminal E. The output terminal E is connected to internal logic circuits in an MOS IC device to supply a lower DC power voltage.

According to the invention, the amplitude of the lower DC output voltage is determined by the pulse duration of the pulse signal from the control circuit 2.

The operation of the bias voltage generating circuit having the foregoing construction in accordance with the first embodiment of the invention will now be described with reference to the waveforms shown in FIG. 2.

Figure 2:
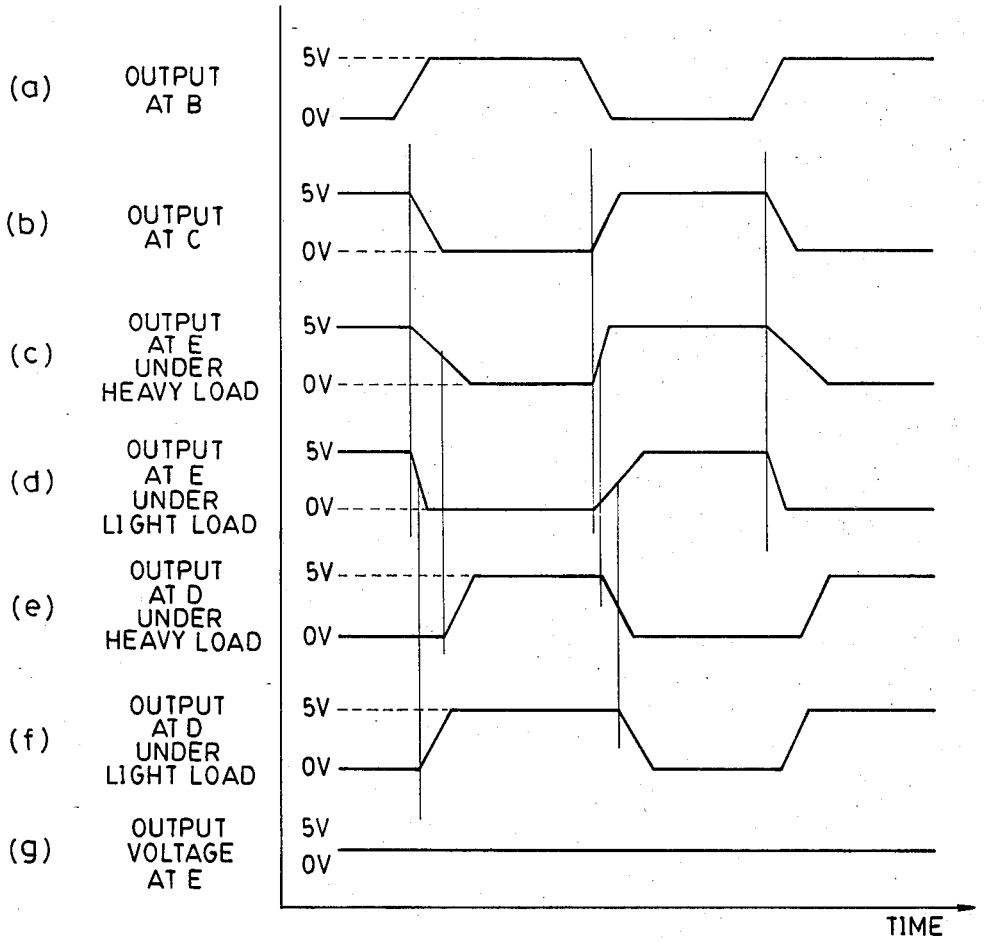
FIG. 2 is a waveform diagram of signals associated with the circuit of FIG. 1 and is useful in describing the operation thereof.

With the application of an external DC voltage (for example, 5 volts) to the input terminal A, the CMOS ring oscillator 1 produces a pulse signal having the waveform of (a) of FIG. 2 to the output terminal B. The pulse signal is inverted by the CMOS inverter 7 as shown in (b) of Fig. The pulse signal at the point C is sent by way of the CMOS inverters 8 and 9 and is converted into a lowered DC voltage as shown in (d) of FIG. 2 by the capacitor C1.

If the output voltage across the capacitor C1 drops due to a heavy load to the output terminal E, the internal resistance of the P-type MOS transistor T7 decreases while the internal resistance of the N-type MOS transistor T10 increases. As a result, the switching of the CMOS inverter 7 becomes fast in rise time and slow in fall time, as shown in (c) of FIG. 2. The CMOS inverter 8 outputs the pulse signal as shown in (e) of FIG. 2. This results in an increase in the conductive time of the P-type MOS transistor T13, so that the voltage drop at the output terminal E is compensated for so as to increase a voltage at the output terminal E.

In the similar manner, when the voltage at the output terminal E suddenly boosts, the switching of the CMOS inverter 7 becomes slow in rise time and fast in fall time, as shown in (d) of FIG. 2. The CMOS inverter 8 outputs the pulse signal as shown in (f) of FIG. 2. This results in an increase in the conductive time of the N-type MOS transistor T14, so that the voltage boosts at the output terminal E is compensated for so as to regulate the voltage of the output terminal E.

Figure 3:
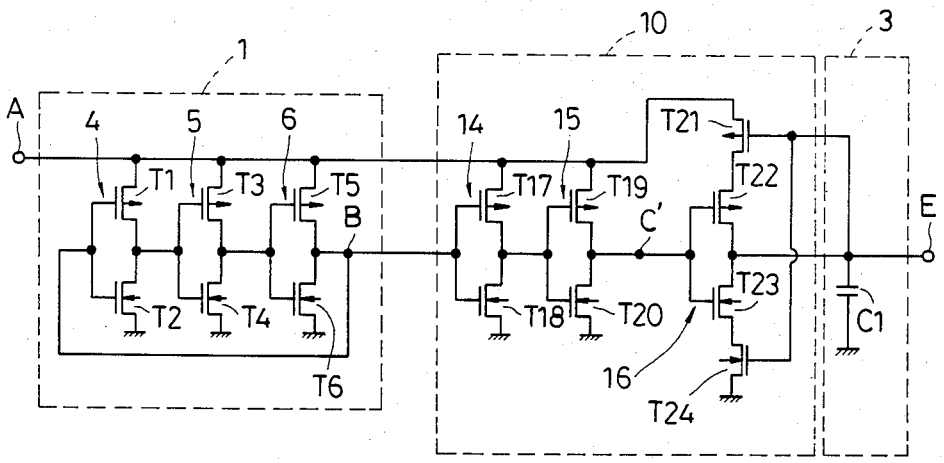
FIG. 3 is a circuit diagram illustrating a second embodiment of a bias generating circuit according to the present invention.

A second embodiment of the present invention will now be described with reference to FIG. 3. The control circuit 2 in FIG. 1 is modified in FIG. 3.

A control circuit 10 comprises CMOS inverters 14, 15, 16, a P-type MOS transistor T21, and an N-type MOS transistor T24. Each CMOS inverter includes a P-type MOS transistor and an N-type MOS transistor. The CMOS inverters 14 and 15 are serially connected to vary the pulse duration of the output signal from the ring oscillator 1. The CMOS inverters 14 and 15 also act as a buffer for shaping the output signal of the CMOS ring oscillator 1.

The CMOS inverter 16 is placed between the output of the CMOS buffer 15 and the output terminal E to invert an output signal of the CMOS inverter 15. The MOS transistors T21 and T24 are controlled by a voltage at the output terminal E to adjust the transconductance (gm) of the CMOS inverter 16.

The operation of the bias generating circuit according to the second embodiment of the invention will now be described with reference to FIG. 4.

Figure 4:
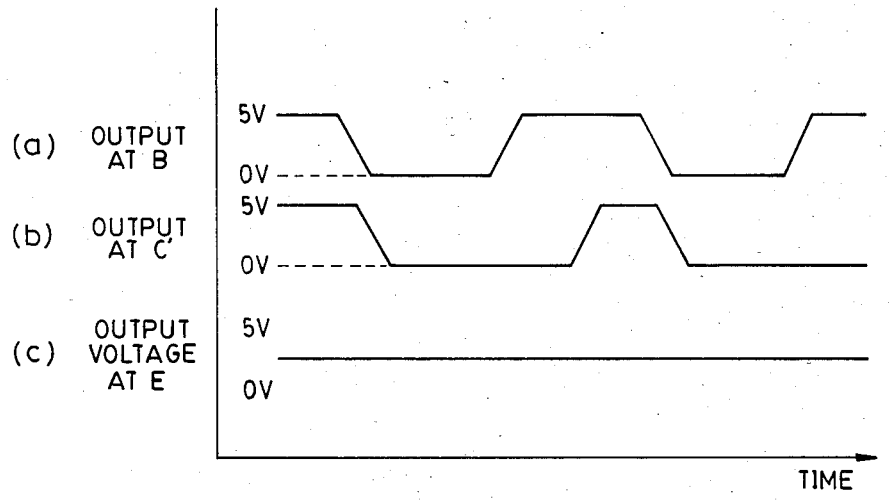
FIG. 4 is a waveform diagram of signals associated with the circuit of FIG. 3 and is useful in describing the operation thereof.

With the application of an external DC voltage (for example, 5 volts) to the input terminal A, the CMOS ring oscillator 1 produces a pulse signal as shown in (a) of FIG. 4. The pulse signal has its pulse duration varied in the CMOS inverters 14 and 15 as shown in (b) of FIG. 4. The pulse signal at the point C' is inverted by the CMOS inverter 16 and is smoothed by the capacitor C1 to convert into a lower DC voltage in response to a change in the voltage at the output terminal E, as shown in (c) of FIG. 4. The voltage variation due to a load at the terminal E is regulated by controlling the transconductance of the MOS transistors T21 and T24.

In the bias generating circuit according to the invention, the output DC voltage can be widely changed by making greater the transconductance (gm) ratio between P-type and N-type MOS transistors forming the CMOS inverter. The difference transconductance can be easily obtained by changing MOS transistors in size.

The bias generating circuit according to the invention is particularly applicable to the internal power source for semiconductor memory IC devices.

As many apparently widely different embodiments of the present invention can be made without departing from the spirit and scope thereof, it is to be understood that the invention is not limited to the specific embodiments thereof except as defined in the appended claims.

What is claimed is:

1. A CMOS bias voltage generating circuit for use in a semiconductor integrated circuit device and for reducing an external DC power supply voltage to a lower DC bias voltage, comprising:

oscillating means coupled to said external DC power supply for converting said external voltage into a first clock pulse signal;

smoothing circuit means for converting a second clock pulse signal into said lower DC bias voltage;

CMOS inverter means for inverting said first clock pulse signal from said oscillating means;

CMOS buffer means for varying the pulse duration of the output signal from said CMOS inverter means to output said second clock pulse signal to said smoothing circuit means; and voltage compensating means for varying the transconductance of said CMOS inverter means in response to a variation of said lower DC bias voltage to regulate the pulse duration of said first clock pulse signal to thereby regulate said lower DC bias voltage to a predetermined amplitude.

2. The circuit of claim 1, wherein said voltage compensating means comprises P and N-type MOS transistors connected to said CMOS inverter means, respectively.

3. The circuit of claim 2, wherein said CMOS buffer means comprises a plurality of CMOS inverters serially connected to one another, said oscillating means comprises a CMOS ring oscillator, and said smoothing circuit means comprises a capacitor.

4. A CMOS bias voltage generating circuit for use in a semiconductor integrated circuit device and for reducing an external DC power supply voltage to a lower DC bias voltage, comprising:

oscillating means coupled to said external DC power supply for converting said external voltage into a first clock pulse signal;

smoothing circuit means for converting a second clock pulse signal into said lower DC bias voltage;

CMOS buffer means for varying the pulse duration of said first clock pulse signal from said oscillating means to output said second clock pulse signal;

CMOS inverter means for inverting said second clock pulse signal from said CMOS buffer means; and voltage compensating means for varying the transconductance of said CMOS inverter means in response to a variation of said lower DC bias voltage to regulate the pulse duration of said second clock pulse signal to thereby regulate said lower DC bias voltage to a predetermined amplitude.

5. The circuit of claim 4, wherein said voltage compensating means comprises P and N-type MOS transistors connected to said CMOS inverter means, respectively.

6. A circuit as claimed in claim 5, wherein said CMOS buffer means comprises a plurality of CMOS inverters serially connected to one another, said oscillating means comprises a CMOS ring oscillator, and said smoothing circuit means comprises a capacitor.

* * * * *